US005528127A

United States Patent [19]

Streit

[11] Patent Number: 5,528,127

[45] Date of Patent: Jun. 18, 1996

[54] CONTROLLING POWER DISSIPATION WITHIN A LINEAR VOLTAGE REGULATOR CIRCUIT

[75] Inventor: Lawrence C. Streit, Fishers, Ind.

[73] Assignee: National Semiconductor Corporation, Santa Clara, Calif.

[21] Appl. No.: 243,867

[22] Filed: May 17, 1994

[51] Int. Cl.[6] ..... G05F 1/565

[52] U.S. Cl. ..... 323/269; 323/279

[58] Field of Search ..... 323/269, 275, 323/279

[56] References Cited

U.S. PATENT DOCUMENTS

| | | | |
|---|---|---|---|
| 3,509,448 | 4/1970 | Bland | 323/269 |
| 4,054,830 | 10/1977 | Harrel | 323/8 |
| 4,382,224 | 5/1983 | Miller | 323/269 |
| 4,684,877 | 8/1987 | Shreve et al. | 323/269 |
| 4,792,745 | 12/1988 | Dobkin | 323/269 |
| 5,004,970 | 4/1991 | Barov | 323/279 |

*Primary Examiner*—Jeffrey L. Sterrett
*Attorney, Agent, or Firm*—Limbach & Limbach

[57] ABSTRACT

A method and apparatus for providing a regulated output voltage when supplied with an unregulated input voltage utilizes a detection circuit to selectively steer current between two current paths in order to minimize the amount of power dissipated by a pass device such as a bipolar transistor, MOS transistors, field effect transistors or other current control device.

25 Claims, 8 Drawing Sheets

$V_{out}$ = 5
I_load = 0.083

| INPUT VOLTAGE (VOLTS) | FIGURE 2 CIRCUIT POWER DISSIPATION (WATTS) | FIGURE 3 CIRCUIT POWER DISSIPATION (WATTS) | FIGURE 4 CIRCUIT POWER DISSIPATION (WATTS) | FIGURE 5 CIRCUIT POWER DISSIPATION (WATTS) |
|---|---|---|---|---|
| $V_{Vin}$ | $N_Dis_{Vin}$ | S_Rext=32 $S_Dis_{Vin}$ | P_Rext=132 $P_Dis_{Vin}$ | SP_Rext=87.45 $SP_Dis_{Vin}$ |
| 9 | 0.333 | 0.1111 | 0.212 | 0.15 |
| 9.25 | 0.354 | 0.1319 | 0.217 | 0.148 |
| 9.5 | 0.375 | 0.1528 | 0.222 | 0.143 |
| 9.75 | 0.396 | 0.1736 | 0.225 | 0.138 |
| 10 | 0.417 | 0.1944 | 0.227 | 0.131 |
| 10.25 | 0.438 | 0.2153 | 0.229 | 0.122 |
| 10.5 | 0.458 | 0.2361 | 0.229 | 0.112 |
| 10.75 | 0.479 | 0.2569 | 0.229 | 0.101 |
| 11 | 0.5 | 0.2778 | 0.227 | 0.088 |
| 11.25 | 0.521 | 0.2986 | 0.225 | 0.074 |
| 11.5 | 0.542 | 0.3194 | 0.222 | 0.059 |
| 11.75 | 0.563 | 0.3403 | 0.217 | 0.041 |
| 12 | 0.583 | 0.3611 | 0.212 | 0.023 |
| 12.25 | 0.604 | 0.3819 | 0.206 | 0.003 |
| 12.5 | 0.625 | 0.4028 | 0.199 | 0.018 |
| 12.75 | 0.646 | 0.4236 | 0.191 | 0.039 |
| 13 | 0.667 | 0.4444 | 0.182 | 0.059 |
| 13.25 | 0.687 | 0.4653 | 0.172 | 0.08 |
| 13.5 | 0.708 | 0.4861 | 0.161 | 0.101 |
| 13.75 | 0.729 | 0.5069 | 0.149 | 0.122 |
| 14 | 0.75 | 0.5278 | 0.136 | 0.143 |
| 14.25 | 0.771 | 0.5486 | 0.123 | 0.164 |
| 14.5 | 0.792 | 0.5694 | 0.108 | 0.184 |
| 14.75 | 0.812 | 0.5903 | 0.092 | 0.205 |
| 15 | 0.833 | 0.6111 | 0.076 | 0.226 |
| 15.25 | 0.854 | 0.6319 | 0.058 | 0.247 |
| 15.5 | 0.875 | 0.6528 | 0.04 | 0.268 |
| 15.75 | 0.896 | 0.6736 | 0.02 | 0.289 |
| 16 | 0.917 | 0.6944 | 0. | 0.309 |

FIG. 6

| $V_{out}$ = 5<br>I_load = 0.1<br>INPUT VOLTAGE (VOLTS) | FIGURE 2 CIRCUIT<br>POWER DISSIPATION (WATTS) | FIGURE 3 CIRCUIT<br>POWER DISSIPATION (WATTS) | FIGURE 4 CIRCUIT<br>POWER DISSIPATION (WATTS) | FIGURE 5 CIRCUIT<br>POWER DISSIPATION (WATTS) |
|---|---|---|---|---|
| $V_{Vin}$ | $N_Dis_{Vin}$ | S_Rext=32<br>$S_Dis_{Vin}$ | P_Rext=132<br>$P_Dis_{Vin}$ | SP_Rext=87.45<br>$SP_Dis_{Vin}$ |
| 9 | 0.4 | 0.08 | 0.279 | 0.217 |
| 9.25 | 0.425 | 0.105 | 0.288 | 0.218 |
| 9.5 | 0.45 | 0.13 | 0.297 | 0.218 |
| 9.75 | 0.475 | 0.155 | 0.304 | 0.217 |
| 10 | 0.5 | 0.18 | 0.311 | 0.214 |
| 10.25 | 0.525 | 0.205 | 0.316 | 0.21 |
| 10.5 | 0.55 | 0.23 | 0.321 | 0.204 |
| 10.75 | 0.575 | 0.255 | 0.325 | 0.197 |
| 11 | 0.6 | 0.28 | 0.327 | 0.188 |
| 11.25 | 0.625 | 0.305 | 0.329 | 0.178 |
| 11.5 | 0.65 | 0.33 | 0.33 | 0.167 |
| 11.75 | 0.675 | 0.355 | 0.33 | 0.154 |
| 12 | 0.7 | 0.38 | 0.329 | 0.14 |
| 12.25 | 0.725 | 0.405 | 0.327 | 0.124 |
| 12.5 | 0.75 | 0.43 | 0.324 | 0.107 |
| 12.75 | 0.775 | 0.455 | 0.32 | 0.088 |
| 13 | 0.8 | 0.48 | 0.315 | 0.068 |
| 13.25 | 0.825 | 0.505 | 0.309 | 0.047 |
| 13.5 | 0.85 | 0.53 | 0.303 | 0.024 |
| 13.75 | 0.875 | 0.555 | 0.295 | 0 |
| 14 | 0.9 | 0.58 | 0.286 | 0.025 |
| 14.25 | 0.925 | 0.605 | 0.277 | 0.05 |
| 14.5 | 0.95 | 0.63 | 0.266 | 0.076 |
| 14.75 | 0.975 | 0.655 | 0.255 | 0.1 |
| 15 | 1 | 0.68 | 0.242 | 0.125 |
| 15.25 | 1.025 | 0.705 | 0.229 | 0.151 |
| 15.5 | 1.05 | 0.73 | 0.215 | 0.175 |
| 15.75 | 1.075 | 0.755 | 0.2 | 0.201 |
| 16 | 1.1 | 0.78 | 0.183 | 0.225 |

FIG. 8

| $V_{out}$ = 5<br>I_load = 0.125<br>INPUT VOLTAGE (VOLTS) | FIGURE 2 CIRCUIT<br>POWER DISSIPATION (WATTS) | FIGURE 3 CIRCUIT<br>POWER DISSIPATION (WATTS) | FIGURE 4 CIRCUIT<br>POWER DISSIPATION (WATTS) | FIGURE 5 CIRCUIT<br>POWER DISSIPATION (WATTS) |
|---|---|---|---|---|
| $V_{Vin}$ | $N_Dis_{Vin}$ | S_Rext=32<br>$S_Dis_{Vin}$ | P_Rext=132<br>$P_Dis_{Vin}$ | SP_Rext=87.45<br>$SP_Dis_{Vin}$ |
| 9 | 0.5 | 0. | 0.379 | 0.317 |
| 9.25 | 0.531 | 0.0313 | 0.394 | 0.325 |
| 9.5 | 0.563 | 0.0625 | 0.409 | 0.331 |
| 9.75 | 0.594 | 0.0938 | 0.423 | 0.336 |
| 10 | 0.625 | 0.125 | 0.436 | 0.339 |
| 10.25 | 0.656 | 0.1563 | 0.447 | 0.341 |
| 10.5 | 0.688 | 0.1875 | 0.458 | 0.342 |
| 10.75 | 0.719 | 0.2188 | 0.468 | 0.341 |
| 11 | 0.75 | 0.25 | 0.477 | 0.338 |
| 11.25 | 0.781 | 0.2813 | 0.485 | 0.335 |
| 11.5 | 0.813 | 0.3125 | 0.492 | 0.329 |
| 11.75 | 0.844 | 0.3438 | 0.499 | 0.323 |
| 12 | 0.875 | 0.375 | 0.504 | 0.315 |
| 12.25 | 0.906 | 0.4063 | 0.508 | 0.305 |
| 12.5 | 0.938 | 0.4375 | 0.511 | 0.294 |
| 12.75 | 0.969 | 0.4688 | 0.514 | 0.282 |
| 13 | 1 | 0.5 | 0.515 | 0.268 |
| 13.25 | 1.031 | 0.5313 | 0.516 | 0.253 |
| 13.5 | 1.063 | 0.5625 | 0.515 | 0.236 |
| 13.75 | 1.094 | 0.5938 | 0.514 | 0.218 |
| 14 | 1.125 | 0.625 | 0.511 | 0.199 |
| 14.25 | 1.156 | 0.6563 | 0.508 | 0.178 |
| 14.5 | 1.188 | 0.6875 | 0.504 | 0.155 |
| 14.75 | 1.219 | 0.7188 | 0.499 | 0.132 |
| 15 | 1.25 | 0.75 | 0.492 | 0.106 |
| 15.25 | 1.281 | 0.7813 | 0.485 | 0.08 |
| 15.5 | 1.313 | 0.8125 | 0.477 | 0.052 |
| 15.75 | 1.344 | 0.8438 | 0.463 | 0.022 |
| 16 | 1.375 | 0.875 | 0.458 | 0.009 |

FIG. 10

CONTROLLING POWER DISSIPATION WITHIN A LINEAR VOLTAGE REGULATOR CIRCUIT

BACKGROUND OF THE INVENTION

1. Field of the Invention

The present invention relates generally to regulated power supplies, and in particular to methods and apparatus for dissipating power in a monolithic linear voltage regulator.

2. Description of the Related Art

Linear regulators are used to generate a constant output voltage which is, within limits, independent of load current and input voltage. One such regulator is a linear buck regulator, wherein the regulated output voltage is less than the input voltage. With reference to FIG. 1, one type of buck regulator is a shunt regulator 100. An input voltage is provided at a voltage input 102 which is connected to one side of a resistor 104. The other side of resistor 104 is coupled to an output voltage node 107, to a load 106 and to one side of a zener diode 108. The zener diode 108 is connected in parallel with load 106 and operates as a non-linear resistance to regulate the potential across load 106 by diverting that portion of the current flowing through resistor 104 which is not provided to load 106. Resistor 104 in turn limits the amount of current drawn by both zener diode 108 and load 106.

Shunt regulator 100 has many advantages. First, it is simple and inexpensive. Second, a discrete through hole (i.e., stud mounted) zener diode or a surface mount zener diode and series resistor can dissipate power (heat) more efficiently than a monolithic arrangement due to thermal impedance between the device (diode and/or resistor) and ambient. However, shunt regulator 100 also has disadvantages. For example, shunt regulator 100 provides inferior line and load regulation when compared to a series regulator. In addition, the current flowing through series resistor 104 directly affects the dropout voltage, that is, the difference in potential from voltage input 102 at node 107 at which regulation ceases.

With reference now to FIG. 2, a series regulator circuit 200 includes a voltage input 202 which is connected to a power source having an unregulated voltage greater than that desired across a load 204. Voltage input 202 is connected to a pass device 206, which typically is a transistor, either integrated within a monolithic regulator's die or a separate discrete device. With this approach, the majority of power supplied by the power source 202 and not provided to load 204 is dissipated in pass device 206. Pass device 206 is further connected at an output voltage node 207 to both load 204 and a resistive divider network 208, which divider network consists of a pair of resistors 210 and 212. The junction of resistors 210 and 212 provides to an inverting input 214 of an error amplifier 216 a known proportion, $(R_{212}/R_{210}+R_{212})$), of the potential across load 204, Vout. A voltage reference 220 provides a constant voltage at a non-inverting input 222 of error amplifier 216. An output 224 of error amplifier 216 is coupled to the pass device (typically a base for a bi-polar transistor, or a gate for a MOS transistor or a field effect transistor). In operation, the known ratio of the voltage across load 204 is provided via divider network 208 and subtracted from the potential of voltage reference 220 by error amplifier 216. The output 224 in turn, directly or indirectly, controls the impedance between nodes 202 and 207 of pass device 206. Stated differently, pass device 206 operates as a variable resistor in series with load 204. As the potential at voltage input 202 changes, and/or as the current drawn by load 204 changes, the feedback provided through error amplifier 216 varies the impedance of pass device 206 from node 202 to node 207 to thereby maintain the desired regulated voltage, Vout, across load 204. Given that the power dissipation of pass device 206 is essentially equal to the product of the current flowing through pass device 206 and the voltage drop across pass device 206, for the same power dissipation, a pass device within a monolithic regulator is normally more expensive than either a discrete through hole pass device or a surface mount pass device because of related packaging costs and heat conduction requirements (thermal impedance from the die to ambient). For this reason, external resistors have been used to dissipate a portion of the power in a monolithic series regulator in order to reduce cost.

FIG. 3 illustrates a regulator circuit 300 which uses a series resistor approach for reducing power dissipation of a pass device. In further detail, an external resistor 302 is connected between a pass device 304 and a load 306 from a power source having an unregulated voltage greater than that desired at an output voltage node 307. As with the series regulator circuit 200 of FIG. 2, a voltage input 308 provides current into pass device 304. A resistive voltage divider 310 consists of a resistor 312 and a resistor 314 which together provide a known proportion $(R_{314}/R_{312}+R_{314})$) of the potential at node 307 (and across load 306), Vout, to an inverting input 316 of an error amplifier 318. A voltage reference 320 provides a constant potential to a non-inverting input 322 of error amplifier 318. An output 324 of error amplifier 318, in response to the potential provided to inverting input 316, provides a yawing potential to pass device 304 to thereby vary the impedance of pass device 304 from voltage input 308 to node 303.

In operation, dissipated power is diverted from the pass device 304 in which regulator circuit 300 resides to external resistor 302. However, as with shunt regulator 100 of FIG. 1, resistor 302 increases the regulator's dropout voltage because the current drawn by load 306 also flows through resistor 302. If there is a varying input voltage at voltage input 308 the value of resistor 302 must be selected so that the additional IR drop (the voltage drop equal to the product of the current through a resistor and the value of the resistor) of resistor 302 does not cause the pass device 304 to saturate at the lowest input voltage, $Vin_{13}$ low, with worst case high load current, I_max. Ignoring the saturation voltage of the pass device 304, the value of resistor 302, S_Rext, can be expressed as:

S_Rext=(Vin_low−Vout)/I_max.

Applying this equation to, for example, an automotive environment where the battery/alternator system voltage can vary from 9 volts to 16 volts D.C.), assuming that the amount of current provided to load 306, at a potential of 5 volts, varies from 0.083 to 0.125 amperes:

Vin_low=9 volts,

Vout=5 volts,

I_max=0.125 amperes,

Thus,

S_Rext=32 ohms.

Transients, however, appearing at voltage input 308 must also be accounted for when selecting the value, S_Rext, of resistor 302. In addition, when load 306 is dynamic, the current through load 306 can momentarily exceed I_max. Thus, by accounting for these factors, the value, S_Rext, of resistor 302 must therefore be deceased, thereby decreasing the effectiveness of using a series approach.

FIG. 4 illustrates another regulator circuit 400, which utilizes a resistor 402 in parallel with a pass device 404. In further detail, regulator circuit 400 includes a voltage input 406 connected to the junction of resistor 402 and pass device 404. Pass device 404 and resistor 402 are connect to an output voltage node 407. A load 408 is also connected to output voltage node 407. The potential at output node 407, Vout, is divided by a divider network 410 which consists of a pair of resistors 412 and 414. The junction of resistors 412 and 414 is connected to an inverting input 416 of an error amplifier 418. A voltage reference 420 is connected to a non-inverting input of error amplifier 418. An output 424 of error amplifier 418 is coupled to a control element (such as a base of a bipolar transistor or a gate of a MOSFET) of pass device 404.

In operation, a portion of the current provided to load 408 flows through resistor 402, the amount of current flowing through resistor 402 being a function of the difference between the potential at voltage input 406, Vin, and the potential across load 408, Vout. The remainder of the load current flows to load 408 through pass device 404. If Vin at voltage input 406 goes too high or the current through load 408 goes too low, pass device 404 turns off and all of the load current then flows through resistor 402, resulting in a cessation of regulation. Therefore, in order to maintain regulation, the value of resistor 402 must be selected based upon the minimum load current, I_min, and the maximum potential at voltage input 406, Vin_high. Not accounting for transients, the desired value of resistor 402, P_Rext, can be expressed as:

P_Rext=(Vin_high−Vout)I_min.

If

Vin_high=16 volts,

Vout=5 volts, and

I_min=0.083 amperes,

Then,

P_Rext=132 ohms.

As with the regulator circuit 300 which utilizes resistor 302, transients at voltage input 406 and in the load current should also be accounted for when calculating P_Rext. Load currents can momentarily go below I_min with dynamic loads, and transients above Vin_high may appear due to changing loads connected in parallel with voltage input 406. Thus, when transients are accounted for, the value of resistor 402, P_Rext, must be increased, which in turn decreases the effectiveness of using resistor 402 in dissipating power. One major advantage of the resistor approach of FIG. 4 over the series resistor approach of FIG. 3 is that, with the parallel approach, the regulator's dropout is basically a function of the pass device 404.

With both the series resistor approach of FIG. 3 and the resistor approach of FIG. 4, their effectiveness as regulators decreases as the range of Vin increases and as the range of the load current increases. The regulator circuit 300 of FIG. 3 more effectively transfers power dissipation to an external resistor with high values of input voltage, Vin, and small load currents. The opposite is true with respect to the regulator circuit 400 of FIG. 4.

Thus, it would be desireable to provide a voltage regulator which does not suffer from the disadvantages of either the series resistor approach or the parallel resistor approach, yet more effectively dissipates power. For a given range of load currents and range of input voltages, it would also be desireable to provide a voltage regulator which dissipates less power in the pass device than the above described circuits.

SUMMARY OF THE INVENTION

It is an object of the invention to provide a method and apparatus for providing a regulated output voltage for varying load currents and varying input voltage.

It is a further object of the invention to provide a method and apparatus for effectively reducing the power dissipated by two or more active elements which regulate output voltage.

It is an additional object of the invention to provide a method and apparatus for effectively responding to input voltage transients and load current transients.

It is an additional object of the invention to provide a method and apparatus for realizing a low dropout voltage.

It is a feature of the invention to detect saturation of a pass device and in response thereto steer current through an alternate controlled path.

It is an additional feature of the invention to base the steering between a series resistance mode and a parallel resistance mode of operation upon input voltage, output (load) voltage and load current.

It is a further feature of the invention to use multiple pass devices and at least one resistance to reduce the amount of power dissipated by two or more active elements which regulate voltage input.

It is an advantage of the invention to reduce dropout when operating with widely varying input voltages.

It is a further advantage of the invention to reduce dropout when operating with widely varying load currents.

It is an additional advantage of the invention to reduce the amount of power dissipated by voltage regulation circuitry within a die.

It is yet another advantage of the invention to reduce the total amount of heat generated by the active elements within a die.

According to one aspect of the invention, a circuit for regulating voltage includes a first current control element for providing a first current path from a power source to a load, a second current control element in series with a resistance, together providing a second current path, the second current path in parallel with the first current path, a sensing circuit for sensing the potential across the load and generating an error signal corresponding to a difference between the potential across the load and a desired potential, a saturation detector for detecting saturation of the second current control element and generating a saturation signal in response thereto, and a circuit for controlling the first and second current control elements to steer current through both the first and second current paths in response to the saturation signal and to steer current through only the second current path in the absence of a saturation signal.

According to another aspect of the invention, there is provided a method of providing a regulated output voltage to a load, including the steps of providing a first current path from a power source to a load, the first current path including a first current control element, providing a second current path from the power source to the load, the second current path including a second current control element in series with a resistance, the second current path in parallel with the first current path, detecting saturation of the second current control element, routing current through both the first and second current paths upon the detection of saturation of the second current control element, and routing current through only the second current path in the absence of detection of saturation of the second current control element.

According to yet another aspect of the invention there is provided a method for controlling the flow of lead current within a linear voltage regulator including the steps of providing a first current control path from a power source to a load, the first current control path including a first current control element, providing a second current control path in parallel with the first current path, the second current path including a second current control element and a linear passive resistance, sensing the potential across the power source, the potential across the load and the amount of current flowing through the load, and generating a steering signal in response thereto, and routing current through both the first and second current control paths in response to the steering signal and to routing current through only the second current control path in the absence of the steering signal.

These and other objects, features and advantages will become apparent when considered with reference to the following description and the accompanying drawings.

BRIEF DESCRIPTION OF THE DRAWINGS

FIG. 6 is a chart of calculated values of power dissipation over an input voltage range from 9.0 volts to 16.0 volts for an output voltage of 5.0 volts and a load current of 0.083 amperes.

FIG. 8 is a chart of calculated values of power dissipation over an input voltage range from 9.0 volts to 16.0 volts for an output voltage of 5.0 volts and a load current of 0.100 amperes.

FIG. 10 is a chart of calculated values of power dissipation over an input voltage range from 9.0 volts to 16.0 volts for an output voltage of 5.0 volts and a load current of 0.100 amperes.

DETAILED DESCRIPTION OF THE PREFERRED EMBODIMENTS

Figure 5:
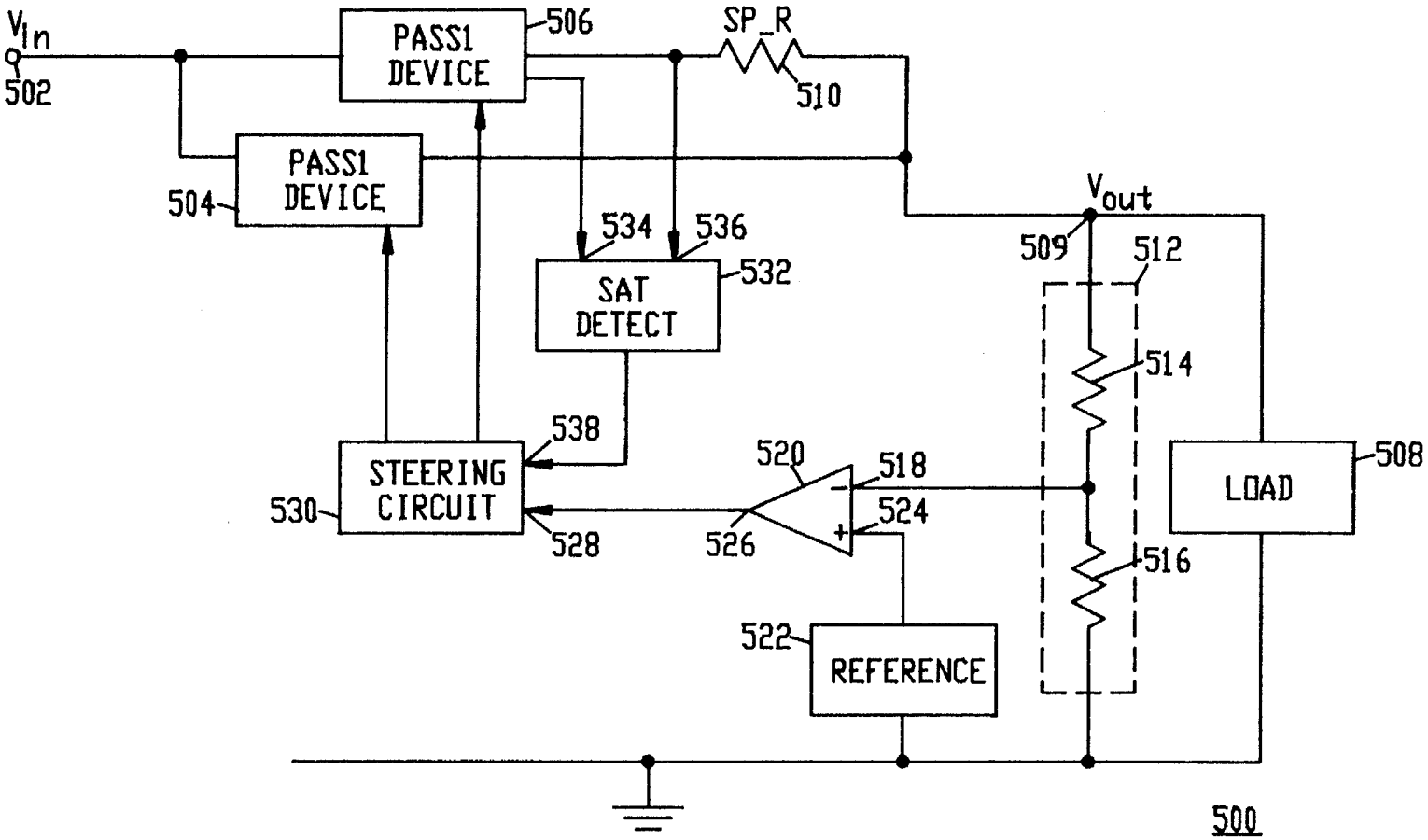
FIG. 5 is a simplified schematic diagram of a voltage regulator circuit in accordance with the present invention.

With reference now to FIG. 5, a circuit 500 for regulating voltage in accordance with the invention is shown. Circuit 500 includes a voltage input 502 coupled to a first pass device 504 and a second pass device 506. As will be understood by those skilled in the art, pass devices 504 and 506 may be any of a number of types of current control devices (i.e., devices which control the flow of current) such as bipolar transistors, MOS transistors and field effect transistors. A load 508 is coupled to an output voltage node 509. Also coupled to the output voltage node 509 is the junction of a resistor 510 and a voltage divider network 512. Voltage divider network 512 consists of a pair of resistors 514 and 516. The junction of resistors 514 and 516 provides a known proportion (equal to R516/(R514+R516)) of the potential at output voltage node 509, Vout, to an inverting input 518 of an error amplifier 520. A voltage reference 522 provides a known constant potential to a non-inverting input 524 of error amplifier 520. An output 526 of error amplifier 520 is provided to a first input 528 of a steering circuit 530. A saturation detector 532 has a first input 534 coupled to second pass device 506 and a second input 536 coupled to the junction of second pass device 506 and external resistance 510. As will be understood by those skilled in the art, a plurality of inputs to saturation detector 532 may be utilized, however, in the preferred embodiment of the invention, the saturation detector detects saturation by indirectly sensing the input voltage, Vin, at voltage input 502, the output voltage, Vout, at output voltage node 509, and the load current through load 508. As will be also understood by those skilled in the art, although in the preferred embodiment of the invention, resistance 510 is a passive linear resistor, resistance 510 may be any linear or non-linear device which provides an IR drop, such as a resistor, light bulb, diode, zener diode, light emitting diode, diode-connected bipolar transistor, thyristor, varistor, thermistor, or combinations of such devices. In the preferred embodiment of the invention, resistance 510 is a resistor which is mounted external of a die which contains other portions of the circuit 500. The regulator circuit 500 may be combined on a single die with another circuit, which circuit constitutes the load. Load 508, however, may also be external to the other portions of circuit 500. However, resistance 510 may also be fabricated within a portion of a die where it will not significantly contribute to thermal runaway of active devices such as pass devices 504 and 506. A second input 538 of steering circuit 530 is coupled to an output 540 of saturation detector 532. As will be understood by those skilled in the art, portions of regulator circuit 500 may be fabricated on separate dies within a common multi-die package, as part of a hybrid package or as a direct die attached to a printed wire board.

Figure 4:
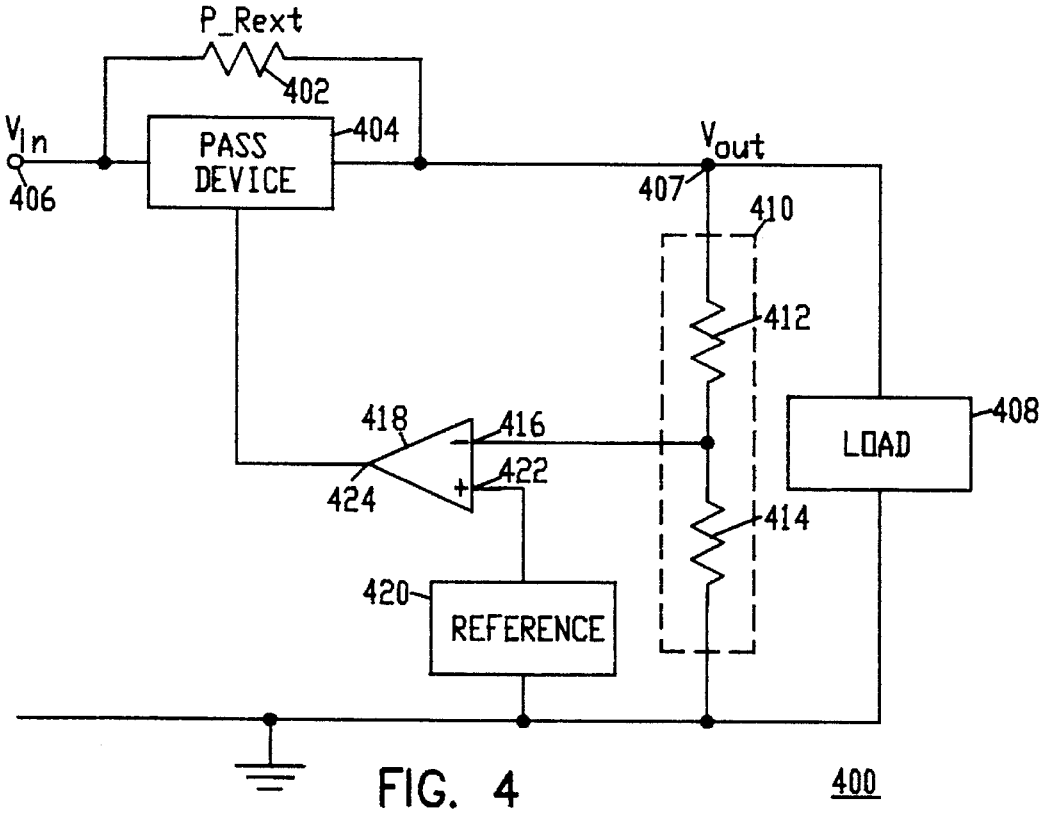
FIG. 4 PRIOR ART
FIG. 4 is a simplified schematic diagram of a series regulator which utilizes an external resistor in parallel with a pass device.

In operation, as the potential, Vin, at voltage input 502 ramps up from zero volts (with respect to ground or common potential), the second pass device 506 becomes saturated and circuit 500 operates similar to regulator circuit 400 of FIG. 4, which regulator circuit 400 utilizes a parallel external resistor 402. In further detail, the saturation detection circuit 532 detects the saturation of second pass device 506. In response to such detection, the output 526 of error amplifier 520 causes steering circuit 530 to bias the first pass device 504 to also conduct current in parallel with pass device 506 and resistance 510. Thus, current flowing from voltage input 502 ultimately to load 508 is steered or routed through two current paths. In this mode, with second pass device 506 saturated, circuit 500 operates similar to regulator circuit 400 of FIG. 4. Once the potential, Vin, at voltage input 502 becomes sufficiently high, the second pass device 506 begins to operate in a linear mode (i.e., is no longer saturated). At this point, saturation detector 532 causes steering circuit 530 to control the conductivity of pass devices 504 and 506 to thereby steer current through only the second pass device 506 instead of through both the first pass device 504 and second pass device 506. Thus, under these conditions the first pass device 504 is off (non-conductive between voltage input 502 and output voltage node 509), and the circuit 500 performs like the regulator circuit 300 which utilizes resistor 302.

In further detail, the optimum value of resistor 510, SP_R, can be expressed as:

SP_R=B×R_load, where

B=(Vin_high−Vout)×0.159, and

R_load=Vout/I_nominal.

As explained later herein with respect to FIG. 7, the factor of 0.159 has been empirically determined from calculations based upon input voltage Vin, output voltage, Vout, and the load current to minimize the power dissipation of the first and second pass devices 504 and 506, respectively, over the 9.0 to 16.0 volt range of input voltage Vin. This factor may vary for different applications. Thus, if Vout=5.0 volts, I_nominal=0.1 amperes, R_load=50 ohms, and Vin_high=16 volts, Then, SP_R=87.45 ohms.

Referring now to FIG. 6, a table of calculated power dissipation for the circuits of each of FIGS. 2, 3, 4 and 5 is shown, where the potential across the load, Vout, is 5.0 volts and the load current, I_load, is 0.083 amperes.

Figure 1:
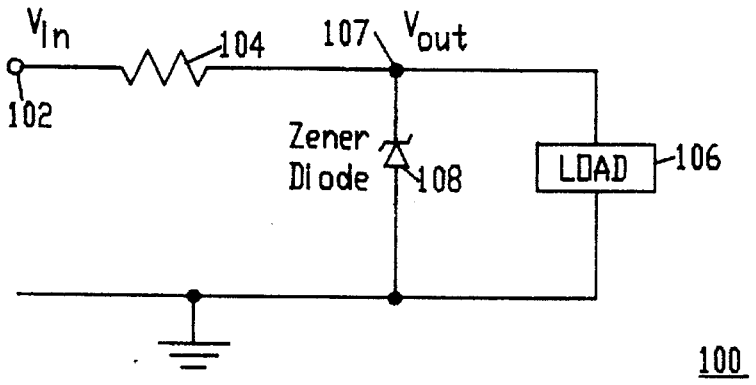
FIG. 1 PRIOR ART
FIG. 1 is a simplified schematic diagram of a voltage regulator circuit known as a shunt regulator.
Figure 2:
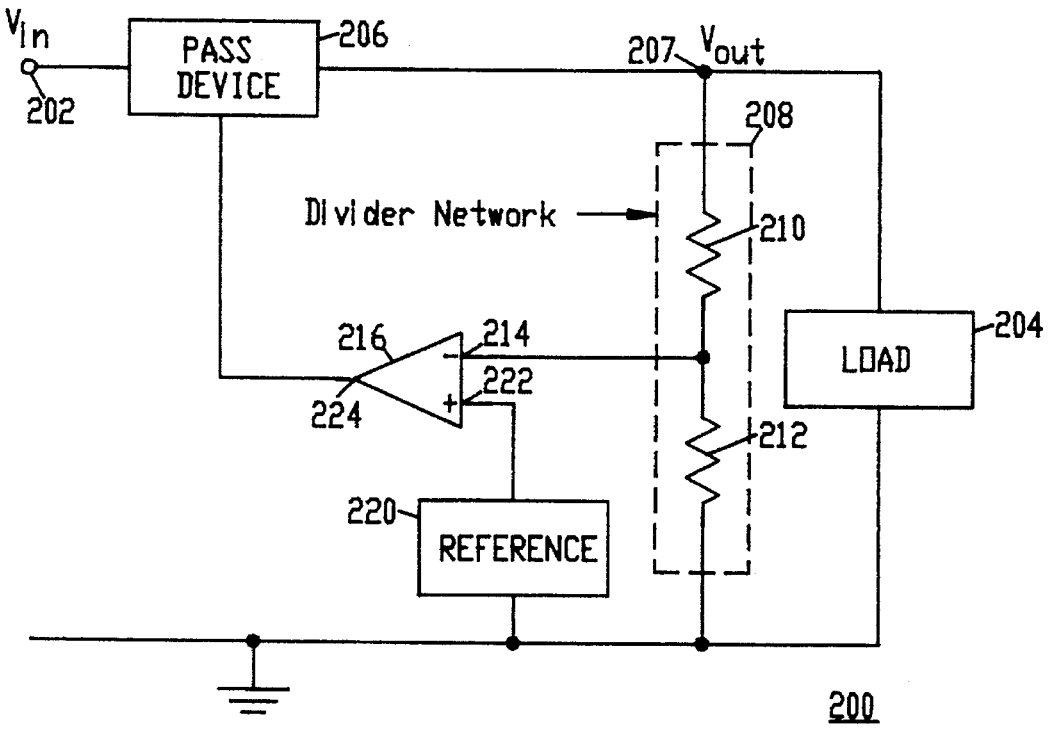
FIG. 2 PRIOR ART
FIG. 2 is a simplified schematic diagram of a voltage regulator circuit known as a series regulator.
Figure 3:
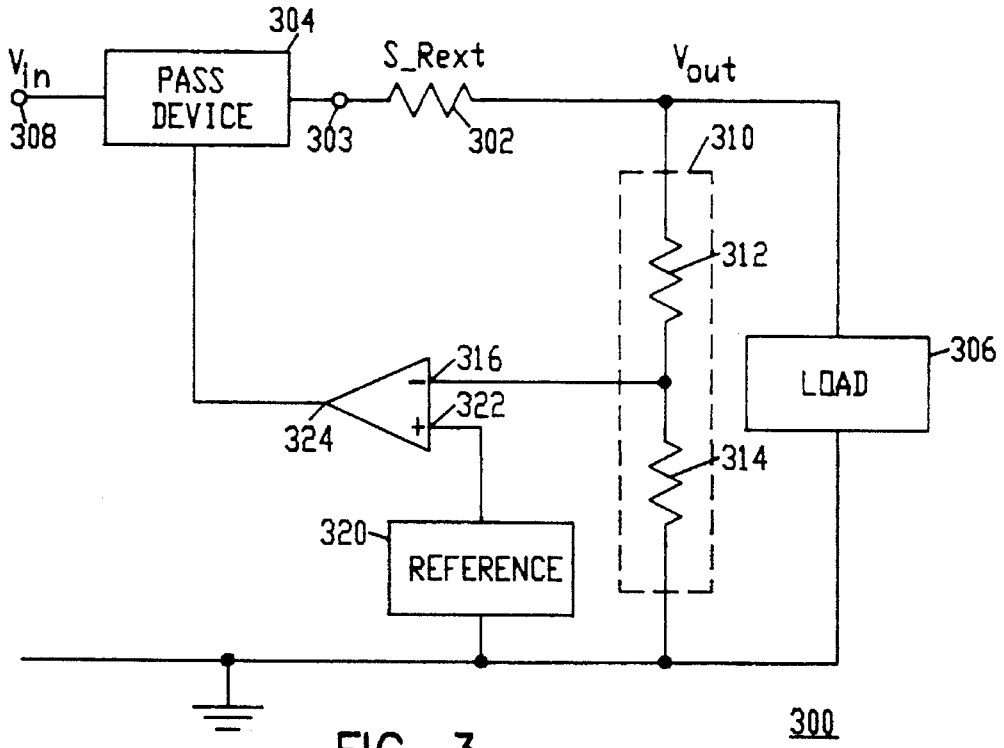
FIG. 3 PRIOR ART
FIG. 3 is a simplified schematic diagram of a series regulator which utilizes an external resistor in series between a pass device and a load.

In further detail, for the regulator circuits of FIGS. 3, 4 and 5, for an input voltage range of 9.0 to 16.0 volts, a load current range of 0.083 to 0.125 amperes and an output voltage, Vout, of 5.0 volts, the value of the resistors 302, 402 and 510 are the optimum values set forth above, namely, 32 ohms, 132 ohms and 87.45 ohms, respectively. For the regulator circuit 200 of FIG. 2, the power dissipated by pass device 206, $N_Dis_{vin}$ can be simply expressed as:

$N_Dis_{vin}=(V_{vin}-Vout)\times I_load$.

For the regulator circuit 300 of FIG. 3, the power dissipation of pass device 304, $S_Dis_{vin}$ can be expressed as:

$S_Dis_{vin}=[V_{vin}-[(I_{\cdot}_{load\times S}_Rext)+5)]]\times I_load$,

For the regulator circuit 400 of FIG. 4, the power dissipation of pass device 404, $P_Dis_{vin}$ can be expressed as:

$P_Dis_{vin=[I}_load-[(V_{vin}-Vout)/P_Rext]]\times(V_{vin}-Vout)$.

For the regulator circuit 500 of FIG. 5, the total power dissipation of pass devices 504 and 506 can be expressed by the following equations:

$Pdiss_{vin}=(V_{vin}\times I_load)-(I_load^2\times SP_{13}\ R)-(Vout\times I_load)$, when pass device 506 is saturated, and $PdissH_{vin}=|I_load-((V_{vin}-Vout)/SP_R)\times(V_{vin}-Vout)|$, when pass device 506 is not saturated.

Figure 7:
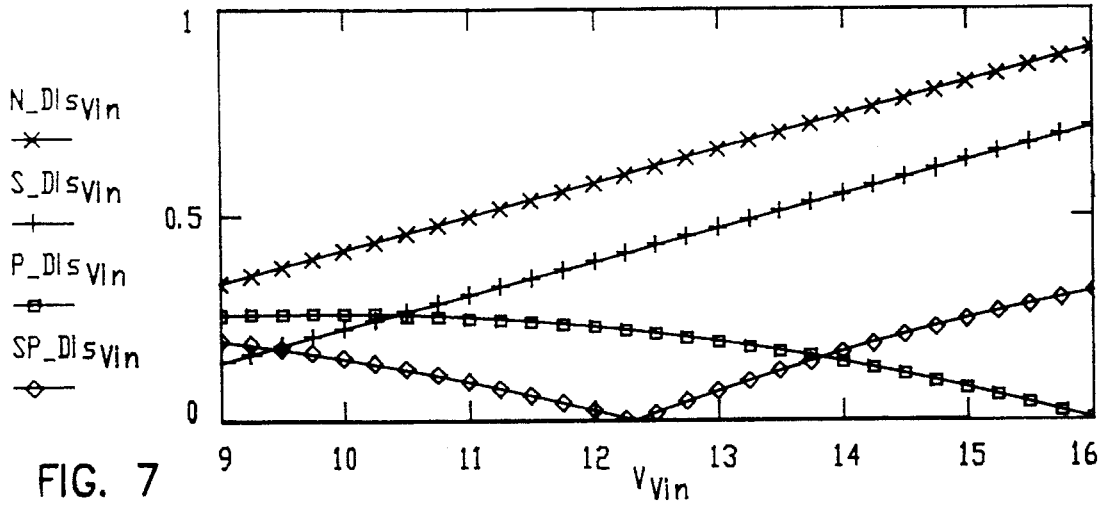
FIG. 7 is a graph of the calculated values of FIG. 6.

As shown in the table of FIG. 6 and as graphically illustrated in FIG. 7, for a Vout=5.0 volts, and I_load=0.083 amperes, as the input voltage, Vin, varies from 9.0 volts to 16 volts., with the circuit 200 of FIG. 2, the amount of power dissipated by pass device 206 increases linearly from a minimum of 0.333 watts to a maximum of 0.917 watts. The range of 9.0 volts to 16 volts is significant in that it is representative of the typical voltage range in an automotive alternator/battery power generation system. Because of the use within automobiles of numerous solid state systems and circuits (for example, powertrain control systems, antilock braking systems, fluid level sensing circuits, radio frequency circuits within audio systems, instrumentation systems, automatic lighting control systems, speed control systems and passive restraint systems) portion of which operate at 5.0 volts derived from voltage regulators operating from an unregulated 9.0 to 16 volts, the provision of a well regulated potential of 5.0 volts is critical.

With the regulator circuit 300 of FIG. 3, which circuit uses resistor 302, the power dissipated by pass device 304 increases linearly from a minimum of 0.1111 watts to a maximum of 0.6944 watts. With the regulator circuit 400 of FIG. 4, which circuit uses resistor 402, the power dissipated by pass device 404 decreases from a maximum of 0.212 watts to 0 watts. Finally, with the circuit 500 of the present invention, the total power dissipated by pass devices 504 and 506 decreases from 0.15 watts to essentially 0.0, then increases from essentially 0.0 to 0.309 watts. These calculations assume no saturation voltage in the respective pass devices.

Figure 9:
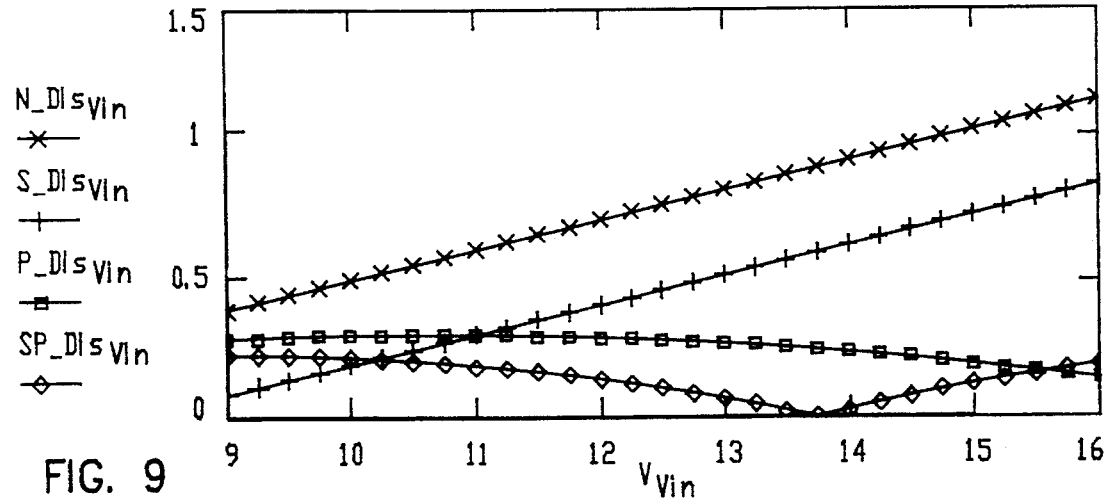
FIG. 9 is a graph of the calculated values of FIG. 8.

Referring now to FIGS. 8 and 9, for a Vout=5.0 volts, and I_load=0.0100 amperes, as the input voltage, Vin, varies from 9.0 volts to 16 volts, with the circuit 200 of FIG. 2, the amount of power dissipated by pass device 206 increases linearly from a minimum of 0.400 watts to a maximum of 1.100 watts. With the regulator circuit 300 of FIG. 3, which circuit uses resistor 302, the power dissipated by pass device 304 increases linearly from a minimum of 0.08 watts to a maximum of 0.78 watts. With the regulator circuit 400 of FIG. 4, which circuit uses resistor 402, the power dissipated by pass device 404 increases from 0.279 to 0.33 then decreases from 0.33 to 0.183. Finally, with the circuit 500 of the present invention, the total power dissipated by pass devices 504 and 506 decreases from 0.217 watts to 0 watts, then increases from 0 watts to 0.225 watts. These calculations assume no saturation voltage in the respective pass devices.

Figure 11:
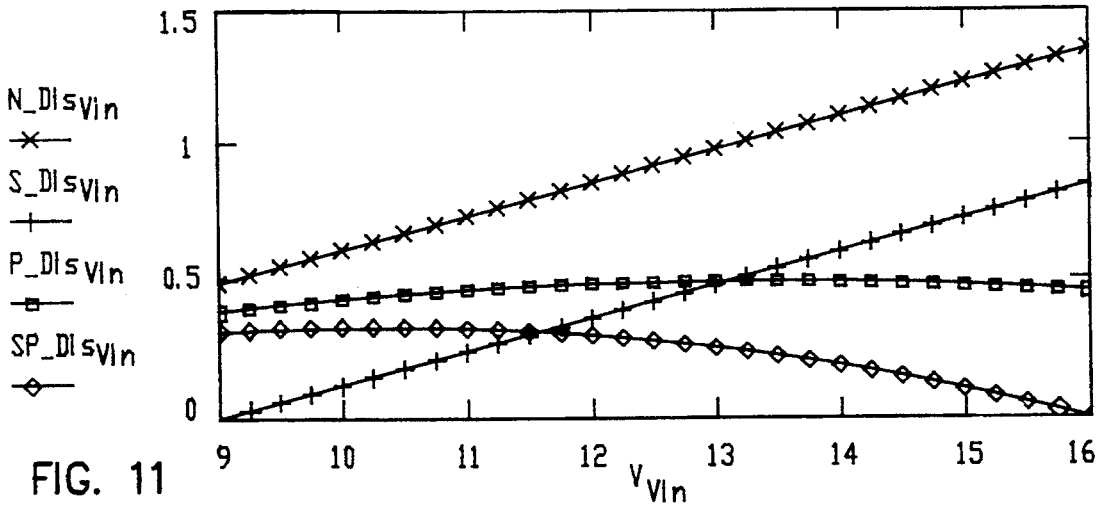
FIG. 11 is a graph of the calculated values of FIG. 8.

Referring now to FIGS. 10 and 11, for a Vout=5.0 volts, and I_load=0.0125 amperes, as the input voltage, Vin, varies from 9.0 volts to 16 volts, with the circuit 200 of FIG. 2, the amount of power dissipated by pass device 206 increases linearly from a minimum of 0.500 watts to a maximum of 1.375 watts. With the regulator circuit 300 of FIG. 3, which circuit uses resistor 302, the power dissipated by pass device 304 increases linearly from a minimum of 0.08 watts to a maximum of 0.78 watts. With the regulator circuit 400 of FIG. 4, which circuit uses resistor 402, the power dissipated by pass device 404 increases from 0.279 to 0.33 then decreases from 0.33 to 0.183. Finally, with the circuit 500 of the present invention, the total power dissipated by pass devices 504 and 506 decreases from 0.217 watts to 0 watts, then increases from 0 watts to 0.225 watts. These calculations assume no saturation voltage in the respective pass devices.

Thus, as the input voltage is swept between 9 and 16 volts, with load currents of 0.083, 0.100 and 0.125 amperes, the following table summaries the worst case values for maximum power dissipation (in watts) of the pass device(s) of each of regulator circuits 200, 300, 400 and 500:

| Circuit | 200 | 300 | 400 | 500 |
|---|---|---|---|---|
| Watts | 1.38 | 0.875 | 0.516 | 0.342 |

By way of comparison, the maximum power dissipation percentage increase over the regulator circuit 500 of FIG. 5 is:

| Circuit | 200 | 300 | 400 |
|---|---|---|---|
| Increase | 303.51% | 155.85% | 50.88% |

Therefore, there is a clear advantage in the pass device power dissipation of the regulator circuit 500 of the present invention. In addition, where the current drawn by a load is known and relatively constant, and the input voltage Vin is, most of the time, relatively constant, it is possible to select component the value of resistance 510 so that the power dissipated by pass devices 504 and 506 is essentially zero. For example, as shown in FIG. 9, where the input voltage, Vin, is 13.75 volts, and the current drawn by the load, I_load, is 0.1 ampere with a voltage across the load, Vout, of 5.0 volts, the power dissipated by pass devices 504 and 506 is essentially zero.

This would be particularly useful, for example, with a battery operated personal computer (also often referred to as "laptop computers") for in such a computer the load current is essentially constant during execution of most commands, except those requiring access to an internal disk drive. During such access, the disk drive motor draws a significant amount of current relative to the current drawn when the internal disk drive is not accessed. Thus, it would be extremely desirable to reduce the dissipation of power by pass devices, not only for masons of electrical efficiency and reduced battery requirements, but also because of the damaging effect on electrical components of heat generated by such dissipation.

As will be understood by those skilled in the art, placement of pass device 506 and (series) resistance 510, may be reversed such that the pass device 506 is coupled to load 508 and resistance 510 is coupled to voltage input 502.

Figure 12:
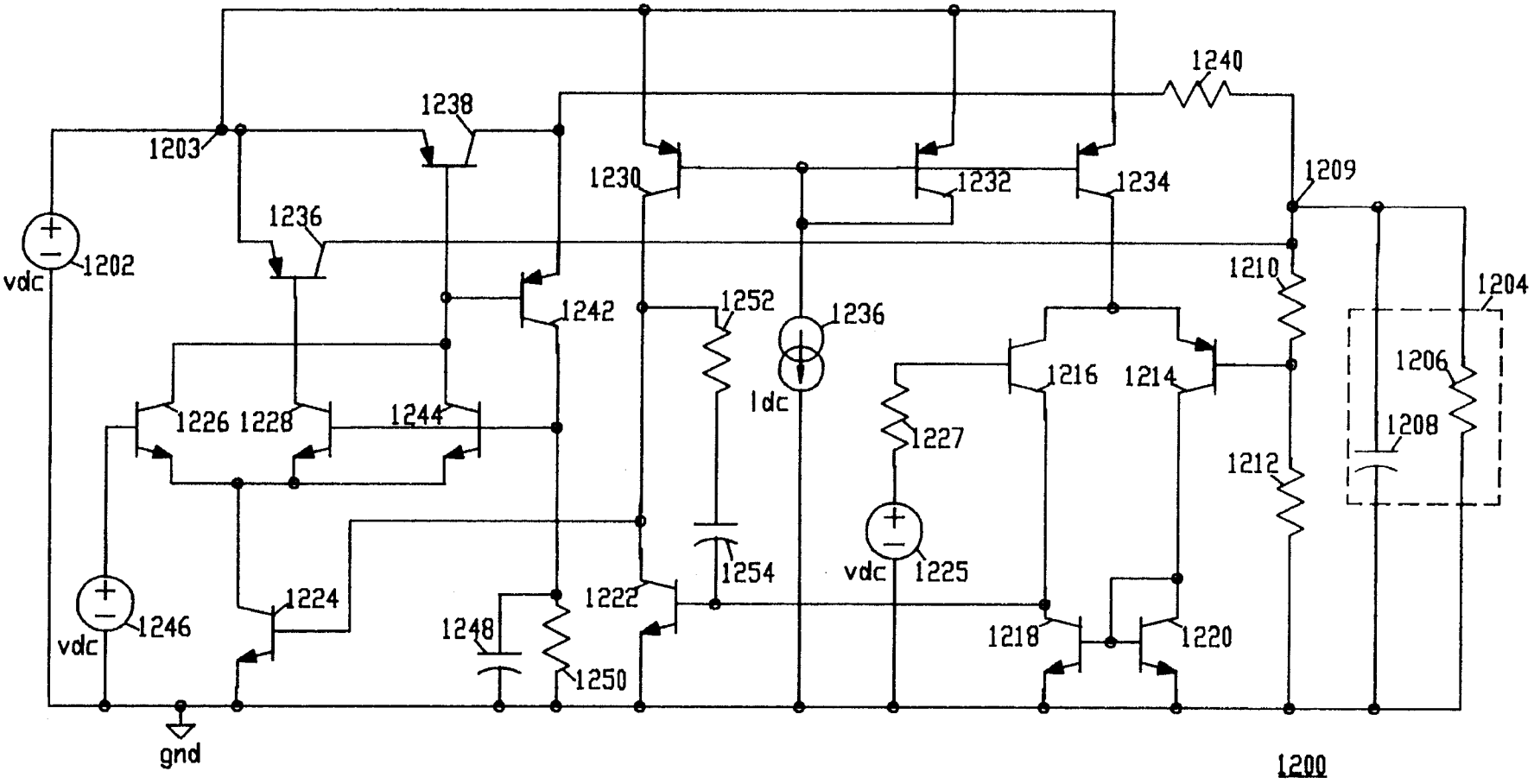
FIG. 12 is a detailed schematic diagram of a voltage regulator circuit in accordance with the present invention.

With reference now to FIG. 12, a detailed schematic diagram of the voltage regulator 500 of FIG. 5 is now described. Circuit 1200 includes an unregulated voltage source 1202 coupled to a voltage input node 1203. A load 1204, which is represented by the parallel combination of a resistance 1206 and a capacitance 1208, is connected between ground (or common) and an output voltage node 1209. A voltage divider consisting of a pair of resistors 1210 and 1212, senses the potential at output voltage node 1209 ( and thus, across load 1204) and provides a known proportion, (R1212/(R1210+R1212), of this potential to the base of a transistor 1214. Transistor 1214 is part of an error amplifier consisting additionally of a transistor 1216, a pair of transistors 1218 and 1220 and transistors 1222 and 1224. A voltage reference 1225 is coupled to the base of transistor 1216 through a resistor 1227. Resistor 1227 operates to compensate for the offset created by resistors 1210 and 1212. Transistors 1214 and 1216 provide to the base of transistor 1222, through the junction of the collectors of transistors 1216 and 1218, a differential signal corresponding to the difference between the potential at the base of transistor 1214 and the potential at the base of transistor 1216.

Transistor 1222 provides most of the gain within the error amplifier. The collector of transistor 1222 drives the base of transistor 1224. Transistor 1224 operates as a driver to control the amount of current flowing through the emitters of transistors 1226, 1228 and 1244, as explained further herein. Transistors 1230, 1232 and 1234 together with a current source 1236 set the collector currents within the error amplifier. In further detail, current flowing from the collector of transistor 1234 establishes the amount of current flowing through the emitters of transistors 1214 and 1216. Current from the collector of transistor 1230 establishes the amount of current flowing through the collector of transistor 1222.

A transistor 1236 operates as a first pass device, corresponding to the first pass device 504 of FIG. 5. A transistor 1238 operates as a second pass device, corresponding the second pass device 506 of FIG. 5. In the preferred embodiment of the invention as shown in FIG. 12, transistors 1236 and 1238 are bipolar transistors. However, other current control devices such as MOS transistors or field effect transistors may be utilized, with appropriate changes to account for the differences in device characteristics.

A resistance 1240, corresponding to resistance 510 of FIG. 5, couples the collector of transistor 1238 to output voltage node 1209 and thus to load 1204. A transistor 1242 operates as the saturation detector 532 of FIG. 5, to detect saturation of transistor 1238, and in response to such detection to generate a saturation signal which is provided to the base of each of transistors 1228 and 1244. In operation, transistor 1226 functions as an opposite side of a differential pair (consisting of transistors 1226 and 1244) when the junction of the collector of transistor 1242 and the base of transistors 1228 and 1244 is low. When no current flows from transistor 1242, all of the current flowing through transistor 1224 is steered through transistor 1226 to thereby turn on transistor 1238 and thus steer substantially all of the load current through transistor 1238. A voltage reference 1246 provides a fixed potential to the base of transistor 1226.

When the potential at input voltage node 1203 drops sufficiently and/or the amount of current drawn by load 1204 increases sufficiently, second transistor 1238 saturates, thereby turning on transistor 1242. This lifts the potential at the junction of the collector of transistor 1242 and the base of each of transistor 1228 and a transistor 1244. This lift in potential at such junction begins to steer current in transistors 1226 and 1244. Transistor 1244 in turn keeps transistor 1238 in a conductive state, while transistor 1228 turns on transistor 1236.

When the base of each of transistors 1228 and 1244 rises sufficiently to turn off transistor 1226, current then flows through transistor 1228 to thereby control the current flowing from the emitter of transistor 1236 to the collector of transistor 1236. In addition, transistor 1244 maintains transistor 1238 in a state of saturation. Negative feedback is inherently provided in circuit 1200 to prevent transistor 1238 from going into hard saturation.

Transistor 1242 detects, through transistor 1238, the potential of voltage source 1202, Vin, the potential across load 1204, Vout, and the magnitude of the load current flowing through load 1204. Transistors 1224, 1226 and 1228, capacitor 1248 and resistor 1250 operate as the steering circuit 530 of FIG. 5. In further detail, as load current flows through resistance 1240, an IR drop (the product of the load current and the value of resistance 1240) is generated across resistance 1240. Thus, the potential at output voltage node 1209 is equal to the difference between the potential at the collector of transistor 1238 and the IR drop across resistance 1240. When the potential at the collector of transistor 1238 approaches the potential at input voltage node 1203, transistor 1238 saturates. Thus, when $V_{in} \approx V_{out} + (I_{_load} \times R_{1240})$, just before or when transistor 1238 saturates, transistor 1242 turns on. Therefore, the point at which transistor 1242 turns on is determined by indirectly sensing the input voltage $V_{vin}$, the output voltage $V_{out}$, and the load current $I_{_load}$. The values of $V_{in}$, and $V_{out}$ may, however, also be sensed directly at nodes 1203 and 1209, respectively.

A capacitor 1248 and a resistor 1250 operate as a time-constant circuit to slow down transitions at the junction of the collector of transistor 1242 and the base of transistors 1228 and 1244. A resistor 1252 and a capacitor 1254 provide frequency compensation for the circuit 1200.

It is to be understood that although resistance 1240 may be linear or non-linear, resistance 1240 include reactive components (inductive and/or capacitive)parasitic or otherwise, and yet still function in accordance with the invention. Although not necessary, it may be desirable to add a current source, consisting of either a resistor or a transistor, between the base and emitter of each of transistors 1236 and 1238.

Such current sources insures that in the event of any leakage within transistors 1226, 1228 or 1244, as the case may be, that each transistor is completely off at certain points of circuit operation. In addition, such current sources also insure that transistors 1224, 1226, 1228 and 1244 are always correctly biased.

The following component values are recommended for an operative embodiment of the invention where the range of input voltage is 9–16 volts, desired output voltage is 5.0 volts and the range of load impedance is 20 ohms to 10,000 ohms including a capacitive element of 1 microfarad. All area values for transistors are with respect to a relative emitter area of 1 for a monolithic circuit:

| REFERENCE NUMERAL | TYPE | VALUE |
|---|---|---|
| 1210 | resistor | 30.7K ohms |
| 1212 | resistor | 10.0K ohms |
| 1214 | transistor | 1 |
| 1216 | transistor | 1 |
| 1218 | transistor | 1 |
| 1220 | transistor | 1 |
| 1222 | transistor | 3 |
| 1224 | transistor | 20 |
| 1225 | voltage source | 1.23 volts |
| 1226 | transistor | 10 |
| 1227 | resistor | 7.54K ohms |
| 1228 | transistor | 10 |
| 1230 | transistor | 3 |
| 1232 | transistor | 1 |
| 1234 | transistor | 1 |
| 1236 | current source | 50 micro-amperes |
| 1238 | transistor | 250 |
| 1240 | resistor | 70 ohms |
| 1242 | transistor | 20 |
| 1244 | transistor | 10 |
| 1246 | voltage source | 1.23 volts |
| 1248 | capacitor | 10 pico-farads |
| 1250 | resistor | 50K ohms |
| 1252 | resistor | 5K ohms |
| 1254 | capacitor | 5 pico-farads |

Although only certain embodiments have been described in detail, those having ordinary skill in the art will certainly understand that many modifications are possible without departing from the teachings thereof. All such modifications are intended to be encompassed within the following claims.

I claim:

1. A voltage regulation circuit for receiving a variable input voltage and providing a regulated output voltage to a load, comprising:

first current control means for regulating the amount of current flowing through a load;

second current control means including a current control device and a resistance, the second current control means coupled in parallel with the first current control means;

sensing means for sensing the potential across the load to generate an output signal;

potential reference means for generating a predetermined fixed potential;

an error amplification means for generating a control signal corresponding to a difference between the potential across the load and the predetermined fixed potential;

saturation detection means for detecting saturation of the current control device and generating a saturation signal in response thereto; and steering means for controlling the first and second current control means in response to the control signal and for selectively routing current flowing to the load through one of both the first and second current control means and the second current control means in response to a saturation signal.

2. The voltage regulation circuit of claim 1, wherein the first current control means comprises: a transistor.

3. The voltage regulation circuit of claim 1, wherein the current control device comprises:

a transistor.

4. The voltage regulation circuit of claim 1, wherein the resistance comprises:

a resistor.

5. The voltage regulation circuit of claim 1, wherein the sensing means comprises:

a resistive voltage divider coupled across the load.

6. The voltage regulation circuit of claim 1, wherein the potential reference means comprises:

a fixed voltage source.

7. The voltage regulation circuit of claim 1, wherein the error amplification means comprises:

a differential amplifier.

8. The voltage regulation circuit of claim 1, wherein the saturation detection means comprises:

a transistor.

9. The voltage regulation circuit of claim 1, wherein the steering means comprises:

a differential amplifier operative to steer current flowing to the load by controlling the first current control means and the second current control means.

10. A method of providing a regulated output voltage to a load, comprising the steps of:

providing a first current path from a power source to a load, the first current path including a first current control element;

providing a second current path from the power source to the load, the second current path including a second current control element in series with a resistance, the second current path in parallel with the first current path;

detecting saturation of the second current control element;

routing current through both the first and second current paths upon the detection of saturation of the second current control element; and routing current through only the second current path in the absence of detection of saturation of the second current control element.

11. A voltage regulating circuit for receiving current from a power source at variable voltage and providing power to a load at a regulated voltage, comprising:

a first transistor for providing a first current path from the power source to the load;

a second transistor in series with a resistor for providing a second current path from the power source to the load, the second current path in parallel with the first current path;

a first amplifier for sensing the potential across the load and generating an error signal corresponding to a difference between the potential across the load and a reference potential;

a saturation detector for detecting saturation of the second transistor and generating a saturation signal in response thereto; and a second amplifier for controlling the first and second transistors to steer current through both the first and second current paths in response to the saturation signal, and to steer current through only the second current path in the absence of the saturation signal.

12. The voltage regulating circuit of claim 11 , further comprising:

a resistive voltage divider coupled across the load, operative to provide a predetermined proportion of the potential across the load to a first input of the first amplifier; and a potential reference operative to provide the reference potential to a second input of the first amplifier.

13. The voltage regulating circuit of claim 12, wherein the potential reference is a first potential reference, further comprising:

a second potential reference coupled to a first input of the second amplifier; and a resistive-capacitive filter coupled a second input of the second amplifier, operative to increase the rise time of the saturation signal.

14. The voltage regulating circuit of claim 13, further comprising:

a resistor coupled between the first potential reference and the second input of the first amplifier, operative to offset an output signal from the first amplifier.

15. The voltage regulating circuit of claim 13, further comprising:

a plurality of transistors operative to control the level of current drawn by the first amplifier.

16. The voltage regulating circuit of claim 13, wherein the first differential amplifier further comprises:

a driver operative to control the amount of current flowing through the second differential amplifier.

17. A method of controlling a flow of current from a power source having an unregulated voltage to a load to provide a constant potential to the load, comprising the steps of:

providing a first current path from the power source to a load, the first current path including a first transistor;

providing a second current path from the power source to the load, the second current path including a second transistor series with a resistance, the second current path in parallel with the first current path;

detecting saturation of the second transistor;

routing current through both the first and second current paths upon the detection of saturation of the second transistor; and routing current through only the second current path in the absence of detection of saturation of the second transistor.

18. A circuit for providing current to a load at a regulated voltage, comprising:

a first current control element for providing a first current path from a power source to a load;

a second current control element in series with a resistance, together providing a second current path, the second current path in parallel with the first current path;

a sensing circuit for sensing the potential across the load and generating an error signal corresponding to a difference between the potential across the load and a desired potential;

a saturation detector for detecting saturation of the second current control element and generating a saturation signal in response thereto; and a control circuit for controlling the first and second current control elements in response to the error signal and for steering current through both the first and second current paths in response to the saturation signal and steering current through only the second current path in the absence of the saturation signal.

19. A circuit for controlling the flow of load current within a linear voltage regulator, comprising:

a first current control element for providing a first current path from a power source to a load;

a second current control element in series with a resistance, together providing a second current path, the second current path in parallel with the first current path;

a saturation detector for detecting saturation of the second current control element and generating a saturation signal in response thereto; and a control circuit for controlling the first and second current control elements to route current through both the first and second current paths in response to the saturation signal and to route current through only the second current path in the absence of the saturation signal.

20. A method for controlling the flow of load current within a linear voltage regulator, comprising the steps of:

providing a first current path from a power source to a load;

providing a second current path in parallel with the first current path, the second current path including a current control element and a linear passive resistance;

detecting saturation of the current control element and generating a saturation signal in response thereto; and routing current through both the first and second current paths in response to the saturation signal and to routing current through only the second current path in the absence of the saturation signal.

21. A method for controlling the flow of load current within a linear voltage regulator, comprising the steps of:

providing a first current control path from a power source to a load, the first current control path including a first current control element;

providing a second current control path in parallel with the first current path, the second current path including a second current control element and a linear passive resistance;

detecting saturation of the second current control, and generating a saturation signal in response thereto; and routing current through both the first and second current control paths in response to the saturation signal and to routing current through only the second current control path in the absence of the saturation signal.

22. A method for controlling the flow of load current within a linear voltage regulator, comprising the steps of:

providing a first current control path from a power source to a load, the first current control path including a first current control element;

providing a second current control path in parallel with the first current path, the second current path including a second current control element and a linear passive resistance;

detecting saturation of the second current control element by sensing the potential across the power source, the potential across the load and the amount of current flowing through the load, and generating a saturation signal in response thereto; and routing current through both the first and second current control paths in response to the saturation signal and to routing current through only the second current control path in the absence of the saturation signal.

23. A circuit for controlling the flow of load current within a linear voltage regulator, comprising:

a first current control element for providing a first current path from a power source to a load;

a second current control element in series with a resistance, together providing a second current path, the second current path in parallel with the first current path;

sensing means for sensing the potential across the power source, the potential across the load and the amount of current flowing through the load, and for generating a steering signal in response thereto; and a control circuit for muting current through both the first and second current paths in response to the steering signal and for routing current through only the second current path in the absence of the steering signal.

24. A method for controlling the flow of load current within a linear voltage regulator, comprising the steps of:

providing a first current control path from a power source to a load, the first current control path including a first current control element;

providing a second current control path in parallel with the :first current path, the second current path including a second current control element and a linear passive resistance;

sensing the potential across the power source, the potential across the load and the amount of current flowing through the load, and generating a steering signal in response thereto; and routing current through both the first and second current control paths in response to the steering signal and to routing current through only the second current control path in the absence of the steering signal.

25. A voltage regulating circuit for receiving current from a power source power at variable voltage and providing power to a load at a regulated voltage, comprising:

a first transistor for providing a first current path from the power source to the load;

a second transistor in series with a resistor for providing a second current path from the power source to the load, the second current path in parallel with the first current path;

a first amplifier for sensing the potential across the load and generating an error signal corresponding to a difference between the potential across the load and a desired potential;

a detector for detecting the potential across the power source and the potential across the load and generating a steering signal in response thereto; and a second amplifier for controlling the first and second transistors to steer current through both the first and second current paths in response to the steering signal, and to steer current through only the second current path in the absence of the steering signal.

* * * * *